United States Patent [19]

De Santis

[11] 4,388,863

[45] Jun. 21, 1983

[54] SCRAPER BLADES USED WITH PRINT ROLLERS

[75] Inventor: William D. De Santis, Lititz, Pa.

[73] Assignee: Armstrong World Industries, Inc., Lancaster, Pa.

[21] Appl. No.: 323,941

[22] Filed: Nov. 23, 1981

[51] Int. Cl.[3] ..... B41M 1/12; B05D 1/40; B05D 1/28

[52] U.S. Cl. ..... 101/129; 101/120; 101/123; 101/354; 401/15; 401/36; 401/137; 401/208; 427/282; 427/428

[58] Field of Search ..... 101/116–120, 101/123, 126, 124, 354; 427/282, 428; 401/15, 36, 137, 208

[56] References Cited

U.S. PATENT DOCUMENTS

| | | | |
|---|---|---|---|
| 172,067 | 1/1876 | Alexander | 401/208 |
| 1,541,787 | 6/1925 | Cadgene | 101/120 |
| 1,843,116 | 2/1932 | Aldcroftt | 101/126 |
| 2,276,181 | 3/1942 | Foster | 101/122 |
| 2,355,930 | 8/1944 | Thorne | 101/123 |
| 2,549,722 | 4/1951 | Sweet | 401/137 |
| 2,965,020 | 12/1960 | Zimmer | 101/123 |
| 3,751,747 | 8/1973 | Blaeldh | 401/137 |
| 3,919,973 | 11/1975 | Zimmer | 101/122 |
| 3,973,491 | 8/1976 | Porth | 101/123 |
| 4,080,893 | 3/1978 | Wendell | 101/123 |

FOREIGN PATENT DOCUMENTS

| | | | |
|---|---|---|---|
| 135057 | 11/1949 | Australia | 101/123 |
| B 37124 | 12/1956 | Fed. Rep. of Germany | 101/123 |
| 55-28843 | 2/1980 | Japan | 101/123 |
| 163422 | 6/1958 | Sweden | 101/123 |

*Primary Examiner*—Clyde I. Coughenour

[57] ABSTRACT

Print rollers are used on a flatbed screen printer to force the ink through the screen. There is provided scraper blades on either side of the roller assembly so that on the return stroke of the roller assembly some of the printing ink is brought back to the lead roller when it starts its movement. This will insure a supply of ink to the lead roller when it moves into the pattern area of the screen thus giving a more uniform ink deposition across the pattern.

1 Claim, 2 Drawing Figures

SCRAPER BLADES USED WITH PRINT ROLLERS

BACKGROUND OF THE INVENTION

1. Field of the Invention

The invention is directed to a screen printer, and more particularly, to an improvement in the print roller system used in the screen printer.

2. Description of the Prior Art

U.S. Pat. No. 2,965,020 shows a conventional type of dual roller screen printer system.

U.S. Pat. No. 3,804,011 shows a conventional single roll screen printer.

SUMMARY OF THE INVENTION

The invention is directed to a modification in the conventional flatbed screen printer which utilizes reciprocating dual print rollers to squeeze the printing ink through the patterned area of the screen. Wiper or scraper blades are provided adjacent each roller. The wiper blades engage the screen and wipe the surface of the screen contacted by the rollers. The wiper blades move in a reciprocating movement with the rollers and the wiper blades which is trailing its roller, when the roller is moving in one direction, will be pushing printing ink therebefore so that a supply of ink will be available to its adjacent roller when it changes its direction of movement and reciprocates back in the opposite direction from which it initially traveled.

DESCRIPTION OF THE PREFERRED EMBODIMENT

An inherent problem exists with a flat screen printer when print rollers of 2" or more in diameter are utilized. The problem that occurs is the uneven ink application throughout the printing stroke and particularly, at the beginning of the printing stroke. The trailing print roller comes to rest at the end of the each stroke approximately 3" beyond the patterned area of the screen. On the return stroke, the trailing print roller is now the leading print roller and it picks ink out of the reservoir which exists between the two print rollers. As the lead roller picks the ink out of the reservoir, the ink must move around the periphery of the roller and then be deposited on the screen in front of the lead roller to thus form the front ink wedge. If a 3" diameter roller is used, it will take 7" of travel before the ink that is picked up by the lead roller is moved around the periphery of the roller and deposited on the screen. Since there are only 3" of blank screen, the roller will have to travel 4" into the patterned area before ink is in contact with the screen resulting in a 4" wide light area of printing. Such a problem occurs at both ends of a pattern since the pattern is printed through the use of reciprocating rolls.

The invention herein utilizes a scraper blade which is placed in front of the rollers and attached to the print roller frame. The scraper blades generate a supply of ink so it will be available to the leading roller when it first moves off into the pattern area. There is normally excess ink left on a screen by the print rollers, and in addition to scraping off this excess ink, the scraper blade generates a reservoir of ink for the leading roller as it first moves out into a patterned area.

Figure 1:
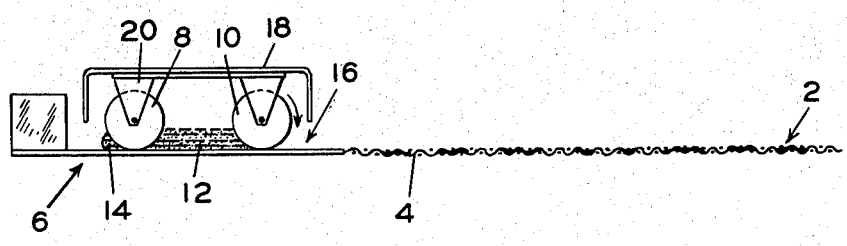
FIG. 1 is a showing of the normal print roller structure.

In FIG. 1, there is shown a conventional dual roll print roller assembly such as that shown in U.S. Pat. No. 2,965,020. The structure of FIG. 1 is used with a flatbed screen printer which would utilize the screen 2 which has a patterned area 4 and a blank or nonpatterned area 6. The print roller assembly is composed of two rolls 8 and 10 which have a reservoir of ink 12 deposited therebetween. As shown on FIG. 1, the print roller assembly has just completed its stroke moving from the right to the left and is now ready to make its return stroke from the left to the right. A number of strokes of a print roller assembly is needed in order to get uniform printing and good penetration of ink into the material being printed under the screen 2. As can be seen in FIG. 1, a supply of ink 14 had been picked up by the roller 8 and moved in front of the roller as it was moving across the screen from the right to the left. It is important that this supply of ink 14 be available for roller 8 while the ink in the reservoir 12 is available for the roll 10 to force ink into the patterned area of the screen. With start of the roller assembly from the left to the right, it will be noted that there is no supply of ink in front of roller 10 which has now become the leading roller as the print roller assembly moves from the left to the right. As indicated above, the 3" leading roller 10 will require 7" of travel before ink is moved from the reservoir 12 around to region 16 in front of roller 10. This supply of ink will not appear until roller 10 is well within the patterned area 4. It should be noted also that the ink supply 14 is going to be left behind when the roller assembly moves to the right and, therefore, over a period of time, a buildup of ink would occur on the far left side of the blank portion of the screen and such a buildup would be undesirable.

Figure 2:
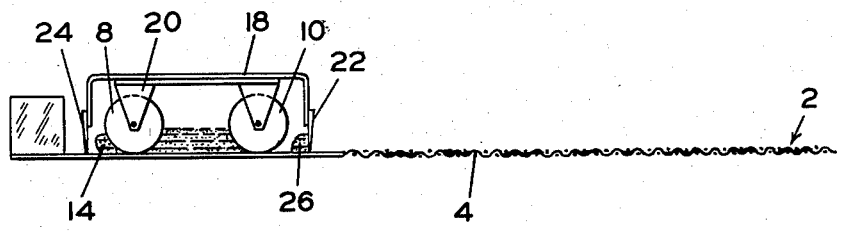
FIG. 2 is a showing of the modified print roll structure utilizing the inventive concept herein.

Referring now to FIG. 2, the scraper blade structure modification herein is shown to overcome both the problem of a generation of an ink supply in the region 16 and additionally to help remove the ink supply 14 so that it does not build up on the left side of the screen. The rollers 8 and 10 are shown in FIG. 2 and a framework 18 is mounted above these rollers. The framework 18 is fixed to the framework 20 which carries the two rollers and moves them in a reciprocating manner. On either end of the framework 18 there was positioned scraper blades 22 and 24. These blades are made of a flexible material such as rubber or urethane so that they can conform generally to the countour of the patterned screen and will provide a wiping action on the upper surface of the screen. They are spaced approximately 1" from the roller that they are positioned adjacent thereto. That is, blade 22 would be approximately 1" from the periphery of roll 10 and blade 24 would be approximately 1" from the periphery of roll 8. Referring now to the ink buildup 14, it will be seen that as the roller assembly moves from the left to the right, scraper 24 will push the ink accumulation 14 along with the roller assembly so that the ink accumulation 14 will be not left on the left side of the screen. It should be noted that an ink accumulation 26 exists by scraper blade 22, and this ink accumulation is immediately available for utilization by roll 10 as it moves into the patterned area 4. This ink accumulation 26 is generated by scraping excess ink off the surface of the screen. The excess ink was that ink which was not picked up and moved along by the printing roll as the printing roll assembly moved from the right to the left. In addition, just as an accumulation of ink 14 would have been left on the left side of the screen, so an ink accumulation would have been left on the right side of the screen and the scraper blade 22 has moved this ink accumulation from the right side of the screen along with the roller assembly as it moved toward the left side of the screen, and the right side ink accumulation is part of the ink accumulation 26. Clearly, it can be seen that the scraper blade assembly modification to a conventional two roll print roller structure now provides adequate ink supply to large rollers when they are utilized with a flatbed screen printer.

What is claimed is:

1. In a method for applying viscous materials to surfaces, and particularly for applying printing ink to the screen surface of a flatbed printer, reciprocating two spaced apart cylindrical print rollers, providing printing ink between the two rollers, providing a patterned screen below said rollers, reciprocating said rollers back and forth across the top of the screen to force printing ink through patterned areas of the screen, the improvement comprising the steps of:

(a) wiping accumulated ink from the top surface of the screen printer from the area behind the print rollers as they are moving in either direction across the screen to accumulate a supply of ink behind the trailing print roller and subsequently, (b) using said accumulated ink as a supply of ink to the former trailing but now leading roller when the direction of travel is reversed to move in the opposite direction back across the print screen.

* * * * *